United States Patent [19]

Iwanicki

[11] 3,930,314

[45] Jan. 6, 1976

[54] DRAFTING MACHINE

[76] Inventor: Andrzej Tomasz Iwanicki, Ostrandsvagen 72, S-122 43 Enskede, Sweden

[22] Filed: Sept. 24, 1973

[21] Appl. No.: 399,978

[52] U.S. Cl. ..... 33/80; 33/26 X

[51] Int. Cl.[2] ..... B43L 13/02

[58] Field of Search ..... 33/79.78, 80, 81, 76, 107, 33/111

[56] References Cited

UNITED STATES PATENTS

| | | | |
|---|---|---|---|
| 1,436,673 | 11/1922 | Nunamaker | 33/79 R |
| 2,089,757 | 8/1937 | Nieuwkamp | 33/76 R |
| 2,713,723 | 7/1955 | Anderson | 33/76 X |
| 2,909,843 | 10/1959 | Bechtel | 33/80 X |

FOREIGN PATENTS OR APPLICATIONS

| | | | |
|---|---|---|---|
| 7,604 | 1915 | United Kingdom | 33/107 CB |
| 345,452 | 12/1921 | Germany | 33/76 R |
| 702,341 | 1/1954 | United Kingdom | 33/80 |
| 11,930 | 1907 | United Kingdom | 33/80 |
| 804,647 | 4/1951 | Germany | 33/76 R |
| 474,702 | 10/1952 | Italy | 33/76 P |

*Primary Examiner*—Harry N. Haroian
*Attorney, Agent, or Firm*—Walter Becker

[57] ABSTRACT

A drafting machine in which parallel support rails moveably support a rule or straight edge extending perpendicularly therebetween so the rule is moveable in parallelism with itself. The rule has a replaceable graduated working edge and carries an endless band which is parallel to the working edge and which has groups of graduations distributed therealong which can be brought into selective registration with the graduations on the working edge. The graduations on the endless band form reducing scales. The rule is profiled and slidably receivable in the profiled rail is an auxiliary instrument which may, conveniently, have a part pivotally mounted thereon for movement in a plane parallel to the work area over which the rule is moveable. The auxiliary instrument is also tiltable away from the working area to expose the working edge of the rule.

6 Claims, 11 Drawing Figures

DRAFTING MACHINE

The present invention relates to a drafting machine with a ruler which at both ends is displaceably guided in guiding means perpendicular to said ruler and which also serves as guiding for an auxiliary drawing element and is provided with a movable graduation.

The heretofore known drawing devices starting with the simplest T-squares which can be moved with and without rollers or guiding means and are held at one or both ends, adjustable T-squares to the most recent drawing machines of the Kuhlmann type or similar machines, lack the precision which is necessary when changing the position. Moreover, the usefulness of heretofore known devices of the type involved is limited because a fast and easy exchangeability of its components and of auxiliary devices is not possible.

It is, therefore, an object of the present invention to provide a drawing machine which will overcome the above-mentioned problems. This object and other objects and advantages of the invention will appear more clearly from the following specification in connection with the accompanying drawings, in which.

Figure 2:
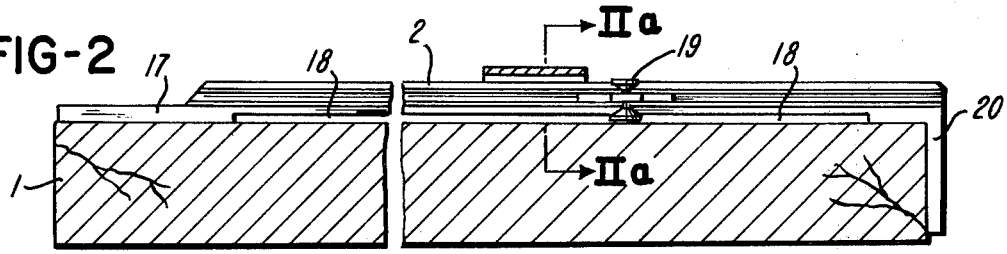
FIG. 2 shows an alternative embodiment of the guiding means for the ruler and the mounting of such guiding means.
Figure 2A:
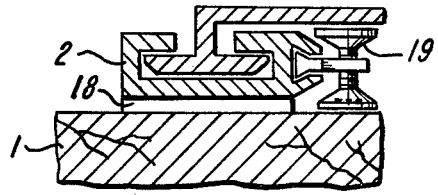

FIG. 2*a* is an enlarged fragmentary sectioned view taken along line II*a*—II*a* in FIG. 2.

Figure 3:
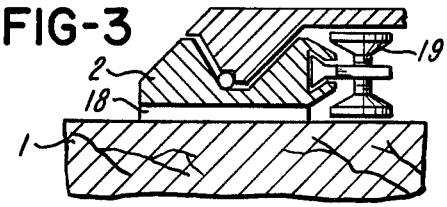

FIG. 3 is still another embodiment of the guiding means for the ruler and the mounting of the guiding means.

Figure 4:
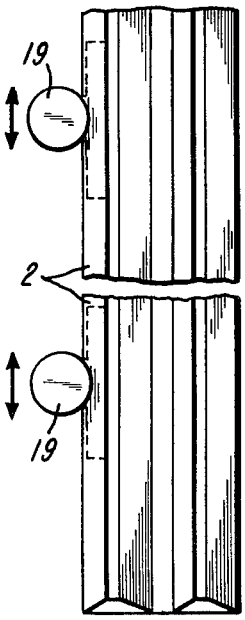

FIG. 4 is a top view of one of the guiding means and also illustrates displaceable holders for the drawing paper, which holding means make it possible to retain the drawing paper on a drawing board without the aid of other devices.

Figure 5:
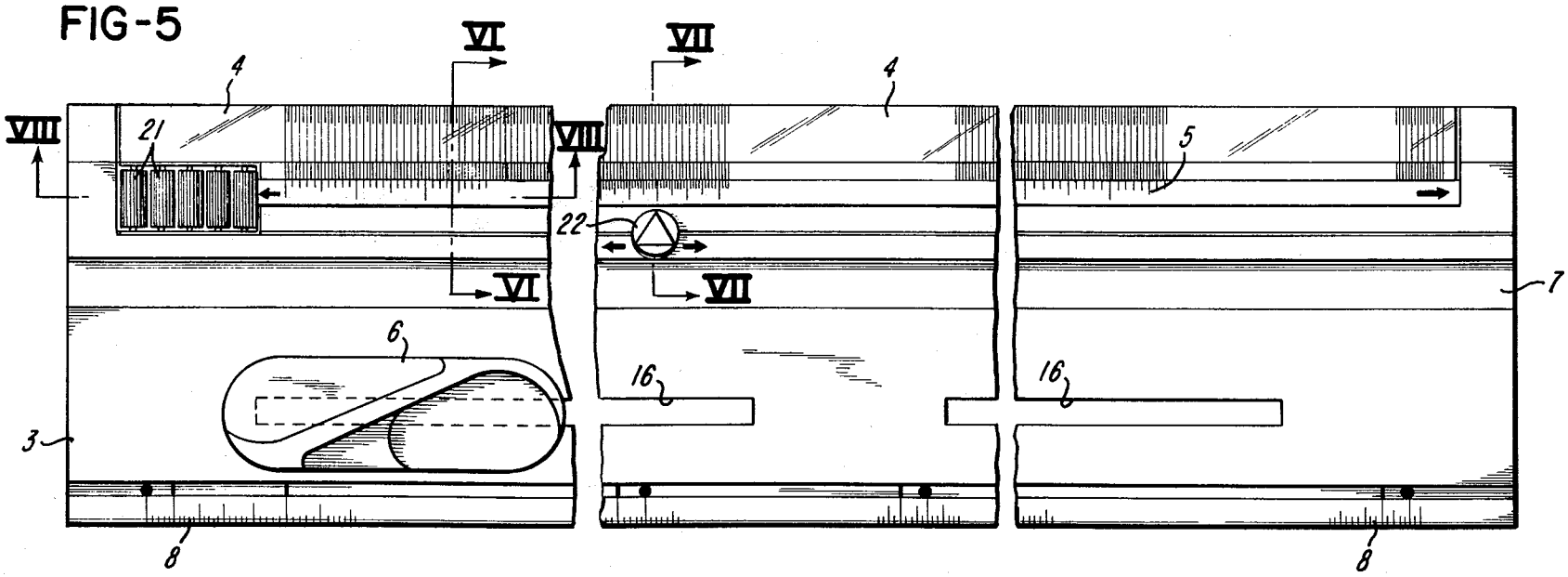

FIG. 5 is a top view of the ruler.

Figure 7:
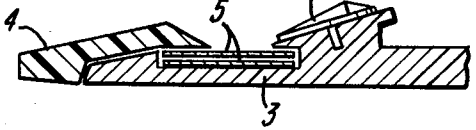
Figure 6:
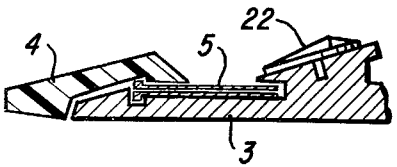
Figure 8:
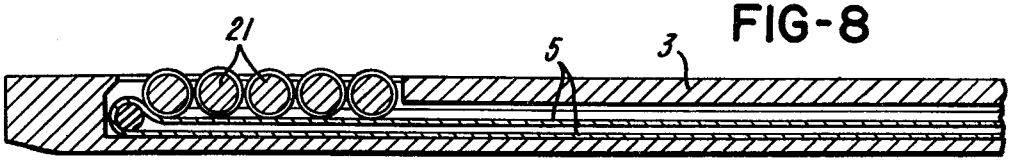

FIGS. 6 and 7 respectively illustrate cross-sections through the ruler. FIG. 8 illustrates the movable graduation.

Figure 9:
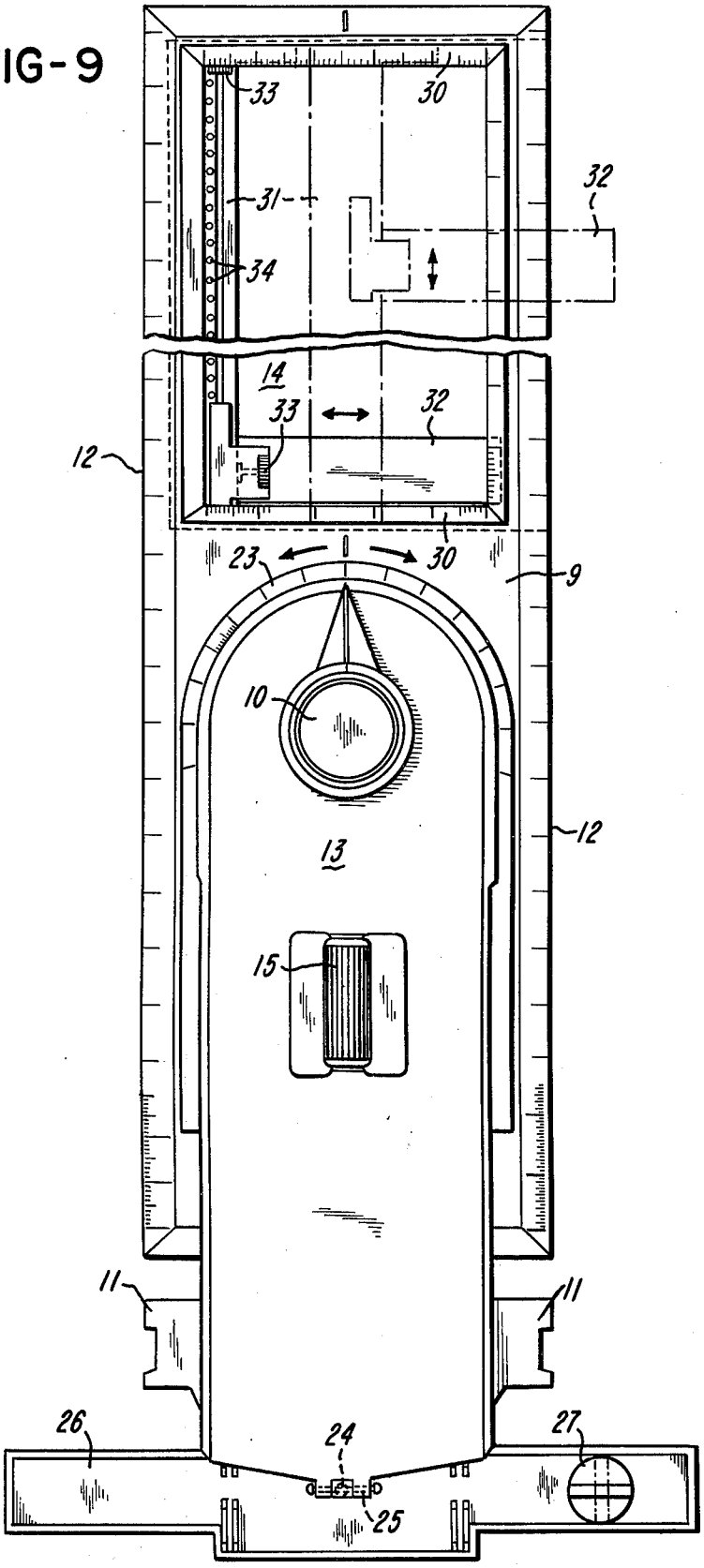

FIG. 9 is a top view of an auxiliary drafting element and of a device for mounting the same on the ruler.

Figure 10:
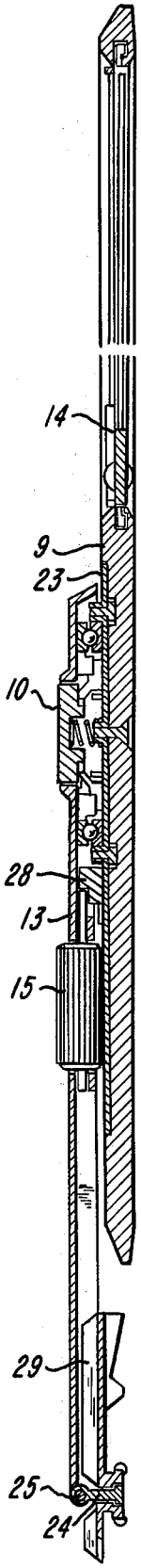

FIG. 10 is a section through the auxiliary drawing element shown in FIG. 9.

The drafting machine according to the present invention is characterized in that the ruler is equipped with an exchangeable working edge which serves as drawing ruler and also as measuring ruler, and in the last-mentioned instance cooperates with the movable graduation which is formed by an endless band having at least two graduations coordinated with the non-movable measuring graduation of the measuring ruler. The graduation of the measuring ruler corresponds to the graduation division of all the graduations of the movable graduation whereby the zero point can on each graduation of the movable graduation be adjusted at any desired point, and measurements and readings can be taken from the zero point away to the working edges of the non-movable graduation of the measuring ruler.

The drawing machine according to the invention can be fastened to any surface serving as drafting board independently of the dimensions and position of said drafting machine and can also be fastened, if desired, to the edge of a table. The drafting machine according to the invention permits the drawing of lines in any direction within 360° in the surface determined by the length of the guiding means. The drafting machine of the present invention can also be employed for drafting horizontal lines perpendicularly with regard to the guiding means and can also be used for drawing vertical lines parallel to the guiding means within the surface confined by the guiding means. The drafting machine according to the invention furthermore permits the employment of the abovementioned auxiliary devices and also permits the use of the entire uninterrupted length of the ruler at the working edge thereof and of all sides of the auxiliary drawing element. The guiding means are connected to the drawing board and may be provided with suitable holders for the drawing paper. The ruler is movable along the guiding means and is provided with a shaped and exchangeable working edge which permits the employment of exchangeable graduations and working edges in conformity with the respective actual requirements. The ruler is furthermore equipped with a movable band graduation while the position and the zero point of such band graduation can be adjusted at will. The ruler serves as guiding means for a displaceable and rotatable auxiliary drafting element, which at the same time is designed as template.

Figure 1:
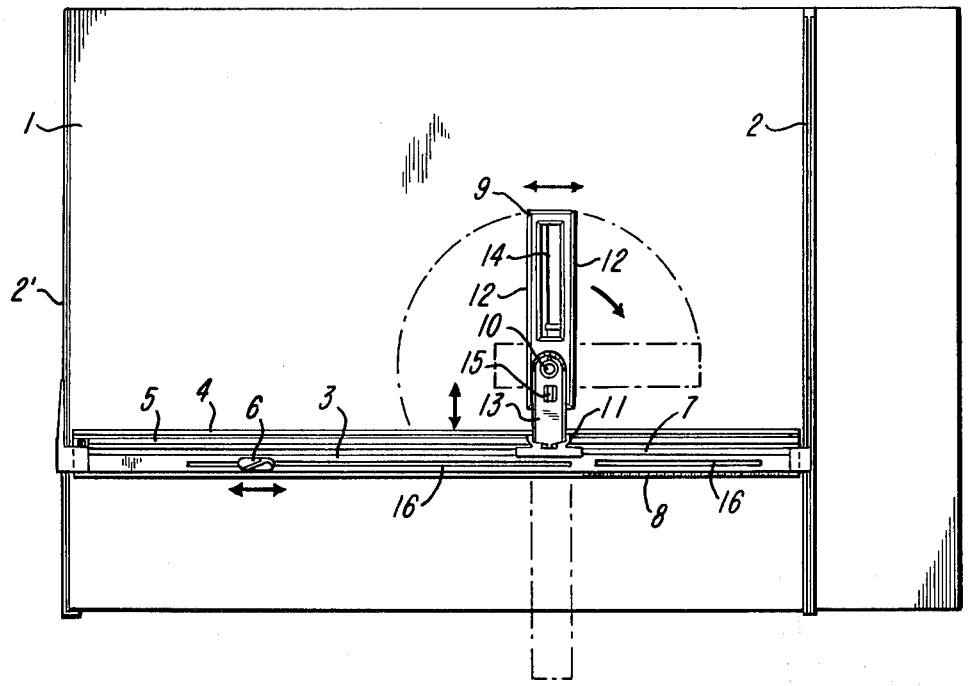
FIG. 1 is a top view of an embodiment of a drafting machine according to the invention with different types of the arrangement of the guiding means.

Referring now to the drawings in detail, the construction of the drafting machine according to the invention makes it possible to displace the ruler 3 along the vertical axis, as will be evident from FIG. 1. According to FIG. 1, the drafting machine is connected to the drawing board 1 by means of guide rails 2 and 2', either on the drawing board or at the edge thereof, while there exists the possibility of mounting the machine at different sections. The exchangeable working edge 4, aided by an associated and displaceable main graduation 5, makes it easyto measure a length along the horizontal axis. A handle 6 facilitates the guiding of the ruler along the guiding rails and can be arrested at different positions along a guiding groove 16 in the ruler in conformity with the desire of the draftsman. A guide 7 extends along the entire length of the ruler 3 and permits the displacement of the auxiliary drafting member 9. The angle position of the auxiliary drafting member can by means of a latching or locking device be easily changed by depressing a knob 10 which is mounted on a connecting plate 13. The adjustment of the auxiliary drafting member 9 at a desired point of the graduation along the ruler is carried out by means of the lateral member 11, the edges of which are flush with the edges 12 of the auxiliary drafting member when the latter is set perpendicularly with regard to the ruler. The edges of the lateral member 11 flare in spaced relationship to each other. The auxiliary drafting member forms a template 14, which comprises movable inner parts and can be arranged in conformity with the respective requirements. The ruler is completed by a fixed auxiliary graduation 8, which may be used for instance to divide a drawing surface into standard measurements.

In contrast to the heretofore known drafting machines, the main elements of the machine according to the invention may be employed separately or in coordination with other devices. The guiding rails may be used for mounting drawing paper on the drawing board so that drawing paper withdrawn directly from a roll can be employed. The ruler with the movable graduation and the exchangeable working edge can also be employed as T-square, and the auxiliary drafting member can be used as a graduation template.

The guiding rails of the drafting machine according to the invention may be of different shape. For instance, they may be designed as closed or semi-closed profiles in conformity with FIG. 2, or they may be designed as open profiles acording to FIG. 3. The guiding rails are provided with a suitable holder which permits the coupling and displacement of the ruler. Moreover, the guiding rails may be equipped with holders for the drawing paper. The additional and characteristic properties are such that the shape of the guiding rails makes the guiding rails stiff in transverse direction, and the guiding rails, if necessary, may be fastened to the lateral edge of the drawing board or on the drawing board, in which instance the connection is effected only at the ends 17 and 20 of the guiding rails, so that the gap 18 between the surface of the drawing board and the bottom side of the guiding rails 2 permits the introduction of drawing paper of unlimited size along the vertical axis or the horizontal axis. Along the entire gap there are displaceable holders 19 for the drawing paper arranged on the guiding rails. In FIG. 4, in which a top view of a guiding rail is shown, there are also shown holders 19 for the drawing paper. These holders 19 are movable along the guiding rail and retain the drawing when the guiding rails are screwed downwardly.

The ruler, the top view of which is shown in FIG. 5 and has the cross-sections illustrated in FIGS. 6, 7, and 8, is designed in contrast to the heretofore known constructions while serving simultaneously as a drafting device and also as a complete measuring device as well as a guiding rail for the auxiliary drafting element. The ruler consists of a suitably designed profile 3 with a fixed graduation 8 and a guiding band 16 for the holder 6, which latter serves for displacing the ruler. Moreover, the profile of the ruler includes a groove 7 which permits in part the guiding of the auxiliary drafting member and in part serves as a profile for placing the exchangeable working edge and the displaceable graduation 5 with the pointer 22 for the zero point in position. The said groove furthermore serves for receiving an adjusting device 21 for adjusting the graduation. The exchangeable working edge 4 has a graduation and preferably consists of transparent material, as for instance Plexiglas or the like. The movable graduation 5 must consist of non-expandable but flexible band material which is provided with one or more graduations corresponding to the graduation on the working edge, so that a free selection of the position of the zero point for each of the graduations along the entire length of the ruler will be possible. Each of these graduations extends over two-thirds of the entire length of the ruler and permits a measurement with a greater precision than was possible with the heretofore known devices. FIG. 5 shows the graduation of the working edge 4 and of the movable graduation 5, which by means of the adjusting device 21 can be replaced by another graduation of the same band. This design makes possible the preparation of drawings with for instance 12 scales:

1:1, 1:10. 1:100, 1:1000. 1:2. 1:20. 1:200, 1:2000, 1:5, 1:500, 1:5000.

FIGS. 6 and 7 respectively illustrate cross-sections of the ruler with different working edges which can be exchanged in conformity with the respective actual requirements.

FIG. 8 shows a portion of a longitudinal section through the ruler and also illustrates the arrangement for exchanging the graduations on the movable graduation band. In contrast to the heretofore known drawing devices and T-squares, the graduation zero point can be adjusted to any suitable point along the entire length of the ruler, and it is possible to carry out measurements directly on the working edge of the ruler for all squares which can be found on the movable band.

The auxiliary drawing element, a top view of which is shown in FIG. 9 and a longitudinal section of which is shown in FIG. 10, consists primarily of the following main components: template arrangement 9 with graduations on the outer edges 12 and on the inner edges 30; displaceable holder 13 which by means of a turning device comprising a pushbutton 10 is connected with the connecting plate 23, to which the auxiliary member 9 is connected. The holder 13 is also connected to a displacement element 26 and to a plate 29 with pointers 11. The turning connection between the holder 13 and the displacement member 26 includes shafts 24 and 25 which make it possible to move the auxiliary drafting element away if it should interfere with the operation of the ruler or another auxiliary device. The position of the holder 13 is arrested by means of indicators on plate 29, which indicators are in suitable position with regard to the holder 13 when the auxiliary drafting element 9 occupies its working position. By depressing the pushbutton 10, the angle position of the auxiliary drafting element can be changed either by a certain amount, for instance 24°, or continuously by 360°. Between the fixed positions of the auxiliary drafting element, the latter is stabilized by the auxiliary device 15 in all positions along a rotation. The base plate 23 has a fine adjustment (vernier) which permits a control of the position of the auxiliary drafting element. The plate 29 of the displacement element 26 has both sides 11 provided with suitable indicators. The width of the distance thereof corresponds to the width of the auxiliary drafting element and which can be used together with the latter. These indicators are located above the graduation of the working edge of the ruler and permit the adjustment of the auxiliary drafting element by a certain distance without the aid of other devices. An arresting device 27 makes possible the arresting of the adjusting member 26 in any position along the ruler. The auxiliary drafting element 9 has a suitably profiled part 14, and the template is provided with two displaceable parts 31 and 32 whereby the adjustment of rectangular figures of different sizes is made possible. The desired position of the parts 31 and 32 is effected by means of screws 33. A holding means 34 along the part 31 serves as holder for the drawing pen or pencil for drawing arcs which can be generated by rotating the auxiliary drafting element toward the desired side. Moreover, it is possible to connect in part 14 further devices, as for instance letters or other symbols. In such an instance the auxiliary drafting element can be employed as universal template which can be arrested in any desired position.

In contrast to all heretofore known devices of the type involved, the auxiliary drafting element simultaneously serves as template, and depending on the wishes of the draftsman can be employed at all four outer edges. It is furthermore possible to put aside the auxiliary drafting element if the work on the ruler or with another device is interfered with by the auxiliary drafting element.

It is, of course, to be understood that the present invention is by no means limited to the specific showing in the drawings but also comprises any modifications within the scope of the appended claims.

What is claimed is:

1. A drafting machine comprising in combination a main ruler, guiding rails adapted for being stationarily mounted and engaging the ends of said main ruler for guiding same on a drawing board in parallelism with itself, an auxiliary instrument slidably guided on said main ruler in the longitudinal direction thereof, a detachable working edge interchangeable in shape on said main ruler having graduations thereon, an endless graduated band carried by said main ruler in parallel to said working edge, said auxiliary instrument having a first part guided in a groove on said main ruler and a second part, means for pivotally mounting said second part on said first part for pivotal movement from a locked position about a first longitudinal axis parallel to said drawing board and about a second axis perpendicular to said drawing board so that said second part can be pivoted about its longitudinal axis and then rotated to a position on the other side of the main ruler, either for drawing purposes or to expose the entire length of said working edge, a third part of said auxiliary instrument being rotatable on said second part in a plane parallel to the drawing board over which said main ruler is moveable.

2. A drafting machine in combination according to claim 1 in which the auxiliary instrument comprises adjustable template means carried thereby and means for drawing arcs, the second part of said auxiliary instrument being locked to said first part against rotational movement in a plane parallel to said drawing board by means of pointers which will adequately hold the second part in position when the instrument is displaced in the groove on said main ruler.

3. A drafting machine comprising a main ruler, guiding rails adapted for being stationarily mounted and engaging the ends of said main ruler for guiding same on a drawing board in parallelism with itself, an auxiliary instrument slidably guided on said main ruler in the longitudinal direction thereof, a detachable working edge on said main ruler having graduations thereon, an endless graduated band carried by said main ruler in parallel to said working edge having at least two different scales thereon, which are coordinated with the graduations on said working edge so that point 0 for each scale on the endless band can be set in an arbitrary position to bring the graduations on each scale of the band into a desired position relative to the graduations on said working edge thereby enabling measurement or read out from point 0 directly on the graduations of said working edge, said guiding rails engaging the ends of said ruler being adapted to be mounted in spaced parallel relation on a drawing board with the ruler extending perpendicularly thereto, each rail including means being displaceable in said rail and provided for releasably engaging the margin of a drawing sheet placed on said board.

4. A drafting machine comprising a main ruler, guiding rails adapted for being mounted on a drawing board at their ends to provide a gap between the surface of the drawing board and the bottom side of the guiding rails, said guiding rails engaging the end of said main ruler for guiding same on said drawing board in parallelism with itself, an auxiliary instrument slidably guided on said main ruler in the longitudinal direction thereof, a detachable working edge on said main ruler being adapted to the specific drawing purpose and having graduations thereon, an endless graduated band carried by said main ruler in parallel to said working edge and being adjustable by means of an adjusting device mounted in said main ruler for unobstructed rotational movement of said endless band having at least two different scales thereon, which are coordinated with the graduations on said working edge, said auxiliary instrument having a first part guided in a groove on said main ruler and a second part, means for pivotally mounting said second part on said first part for pivotal movement about a first longitudinal axis parallel to said drawing board and about a second axis perpendicular to said drawing board so that said second part can be pivoted about its longitudinal axis and then rotated to a position on the other side of the main ruler either for drawing purposes or to expose the entire length of said working edge, a third part of said auxiliary instrument being rotatable on said second part in a plane parallel to the drawing board over which the main ruler is movable.

5. A drafting machine according to claim 4, in which said guiding rails engaging the ends of said ruler are mounted in spaced parallel relation on the drawing board with the ruler extending perpendicular thereto, each rail including means being displaceable in said rail and pivoted for releasably engaging the margin of a drawing sheet placed on said board.

6. A drafting machine comprising a main ruler, guiding rails adapted for being mounted on a drawing board, said guiding rails engaging the end of said main ruler for guiding same on said drawing board in parallelism with itself, an auxiliary instrument slidably guided on said main ruler in the longitudinal direction thereof, a detachable working edge on said main ruler and having graduations thereon, an endless graduated band carried by said main ruler in parallel to said working edge having at least two different scales thereon, which are coordinated with the graduations on said working edge, said auxiliary instrument having a first part guided in a groove on said main ruler and a second part, means for pivotally mounting said second part on said first part for pivotal movement from a locked position about a first longitudinal axis parallel to said drawing board and about a second axis perpendicular to said drawing board so that said second part can be pivoted about its longitudinal axis and then rotated to a position on the other side of the main ruler either for drawing purposes or to expose the entire length of said working edge, a third part of said auxiliary instrument being rotatable on said second part in a plane parallel to the drawing board over which the main ruler is movable.

* * * * *